US010654049B2

(12) United States Patent
Vicentini et al.

(10) Patent No.: US 10,654,049 B2
(45) Date of Patent: May 19, 2020

(54) CENTRIFUGAL SEPARATOR HAVING AT LEAST A VIBRATING UNIT AND ONE OR MORE DRUM SHOCK ABSORBERS

(71) Applicant: MANTOVANI & VICENTINI S.R.L., Via Ballaria (AE)

(72) Inventors: Leonardo Renzo Vicentini, Via Bellaria (IT); Albert Walraven, Dubai (AE)

(73) Assignee: MANTOVANI & VICENTINI S.R.L., Via Ballaria (IT)

( * ) Notice: Subject to any disclaimer, the term of this patent is extended or adjusted under 35 U.S.C. 154(b) by 163 days.

(21) Appl. No.: 15/027,199

(22) PCT Filed: Oct. 2, 2013

(86) PCT No.: PCT/IT2013/000266
§ 371 (c)(1),
(2) Date: Apr. 4, 2016

(87) PCT Pub. No.: WO2015/049703
PCT Pub. Date: Apr. 9, 2015

(65) Prior Publication Data

US 2016/0236208 A1 Aug. 18, 2016

(51) Int. Cl.
*B04B 3/04* (2006.01)
*B04B 7/04* (2006.01)
(Continued)

(52) U.S. Cl.
CPC ..... *B04B 3/04* (2013.01); *B04B 1/20* (2013.01); *B04B 1/2008* (2013.01); *B04B 7/04* (2013.01);
(Continued)

(58) Field of Classification Search
CPC .... B04B 3/04; B04B 1/20; B04B 9/02; B04B 9/10; B04B 9/06; B04B 2001/2091;
(Continued)

(56) References Cited

U.S. PATENT DOCUMENTS 2,340,542 A * 2/1944 Lubberhuizen ..... H02K 7/16 310/272
3,398,888 A * 8/1968 Koenecke ..... B04B 1/20 494/11
(Continued)

FOREIGN PATENT DOCUMENTS

GB 1124713 A * 8/1968 ..... B04B 7/04

OTHER PUBLICATIONS

PCT International Search Report dated May 27, 2014, issued by European Patent Office, The Netherlands, in related International Application No. PCT/IT2013/000266 (3 pages).
(Continued)

*Primary Examiner* — Walter D. Griffin
*Assistant Examiner* — Shuyi S. Liu
(74) *Attorney, Agent, or Firm* — Jeffrey D. Frantz

(57) ABSTRACT

The present disclosure relates to a centrifugal separator (1), which comprises a rotatable drum (5) having a wall (50), an annular chamber (7) defined along the longitudinal axis (49) of the rotatable drum (5) in a portion adjoining to the wall (50), wherein a mixture of substances in the liquid phase and in the solid phase is movable longitudinally through the annular chamber (7), and a discharging station (13) for discharging the solid phase. The discharging station (13) comprises a vibrating unit (300) for agitating the solid phase. The vibrating unit (300) comprises a half-drum (302) and a vibrating device (304) adapted to vibrate the half-drum (302).

8 Claims, 14 Drawing Sheets

(51) Int. Cl.

| | |
|---|---|
| ***B04B 11/02*** | (2006.01) |
| ***B04B 1/20*** | (2006.01) |
| ***B04B 7/06*** | (2006.01) |
| ***B04B 7/18*** | (2006.01) |
| ***B04B 9/02*** | (2006.01) |
| ***B04B 9/06*** | (2006.01) |
| ***B04B 9/10*** | (2006.01) |
| ***B04B 11/00*** | (2006.01) |
| ***B04B 15/06*** | (2006.01) |

(52) U.S. Cl.
CPC ..... *B04B 7/06* (2013.01); *B04B 7/18* (2013.01); *B04B 9/02* (2013.01); *B04B 9/06* (2013.01); *B04B 9/10* (2013.01); *B04B 11/00* (2013.01); *B04B 11/02* (2013.01); *B04B 15/06* (2013.01); *B04B 2001/2091* (2013.01)

(58) Field of Classification Search
CPC .... B04B 7/06; B04B 7/18; B04B 7/04; B04B 15/06; B04B 11/00; B04B 11/02; B04B 1/2008
USPC ..... 494/42, 47, 50, 82
See application file for complete search history.

(56) References Cited

U.S. PATENT DOCUMENTS 3,399,828 A * 9/1968 Fritz ..... B04B 7/04 494/11
3,844,949 A * 10/1974 Mercier ..... B04B 7/04 210/378
4,617,010 A * 10/1986 Epper ..... B04B 1/20 494/44
5,321,898 A * 6/1994 Robinette, Jr. ..... B04B 3/04 210/360.1
7,347,332 B2 * 3/2008 Hakola ..... B04C 5/085 209/159

OTHER PUBLICATIONS

Office Action for the counterpart Brazilian patent application 112016007454-8 dated Nov. 12, 2019 including English translation of the office action.

* cited by examiner

CENTRIFUGAL SEPARATOR HAVING AT LEAST A VIBRATING UNIT AND ONE OR MORE DRUM SHOCK ABSORBERS

The present disclosure relates to a centrifugal separator, particularly for the treatment of drilling fluids, suspensions, slurries and, in general, mixtures of substances in the liquid phase and in the solid phase, which is designed to separate the liquid phase from the solid phase.

In the field of drilling the use of drilling fluids, such as synthetic base fluids or fluids based on water or oil, which are substantially composed of solid and liquid additives, is indispensable.

The separation of the solid phase of the aforementioned fluids, from the liquid phase, is of primary importance both in the processes of disposal of the discarded material obtained from the drilling process, and in the actual drilling process itself.

Disposal of the discarded material obtained from the drilling process, also known as the cuttings, requires the separation of the solid phase from the liquid phase, so as to be able to have a dry solid phase, with reduced volume and capable of being piled, and therefore easily disposed of, while at the same time also recovering the liquid phase, so as to maintain the drilling fluid properties. In fact, the recovery of the liquid phase of the drilling fluids meets both environmental and economic needs, given the high costs of the additives and chemicals used.

In order to carry out such separation, centrifugal separators are known which are constituted by a drum that is rotatable at an adequate speed, with a vertical rotation axis, and frustum-shaped, inside which rotates, at a slightly faster or slower speed, a scraper constituted by a plurality of paddles. The walls of the rotatable drum are constituted by filtering nets, also called screens, which retain the solids inside the drum, while the liquid phase is expelled by the centrifugal effect, passing through the filtering nets. The rotation of the scraper, the paddles of which brush against the inner surface of the filtering nets, is functional to keeping the screens clean, while the solid particles tend to accelerate down along the screens at an increased speed, due to the resultant of the centrifugal force generated by rotation of the drum.

Such centrifugal separators are however designed for the mining industry, and are specific for water based fluids employed in mining. Furthermore, their performance is rather moderate due to the low retention time in relation to the centrifugal forces which increase down along the screens.

With regard to the drilling process, the importance is known for separating the solid phase of drilling fluids from the liquid phase, so that the residue-rich fluids originating from the drilling material can be reused in the drilling process. This technique is known as "solids control" and requires that the drilling fluids, which are rich in the drilling material, pass through a series of solids removal equipment which removes drilled solids in a staggered methodology. Such equipment can comprise a series of vibrating net devices with increasingly fine filtering meshes (known as "shale shakers"), for the removal of the relatively coarse solid phase, and a centrifugal separator (also known as a decanter), thanks to which it is possible to obtain drilling muds that can be reintroduced into the drilling well, as an active part of the drilling process.

The discharge from known solids control equipment is considered relative dry, and an additional process is currently required to dry these solids further, for economic and disposal regulation reasons.

Such conventional centrifugal separators or decanters consist of a rotatable drum with a horizontal axis, frustum-shaped, inside which rotates, at a slightly faster or slower rotation speed, a frustum-shaped screw remover. By virtue of the centrifugal force, the drilling muds are stratified: the solid phase is arranged on the furthest outward annulus inside the rotatable drum and is entrained by the screw remover toward the discharge, while the liquid phase is discharged at the opposite end.

Both types of centrifugal separators described above therefore exhibit the drawback of not being usable, in a flexible manner, for the treatment of different types of fluids, because their effectiveness in separating the liquid phase from the solid phase depends on the type and composition of the processed fluids.

Another drawback of such conventional separators consists in that they generally require continuous and laborious work for maintenance and cleaning, which involve delaying or interruption of the working processes.

A further drawback consists in that, due to the particle size separation, the discharge is still relatively wet.

A further drawback of such conventional separators consists in that the solid phase, once separated from the liquid phase, tends to accumulate at the discharge end of the rotatable drum, thus blocking the discharge of further solid phase. The removal of such solid phase generally requires an operator to intervene and the centrifugal separator to be stopped. Where cleaning of the discharge end is performed by means of flush systems of fluids, a fluid content is added to the discharged solids and this results in getting the solid phase wet again, as well as in increasing the friction wear on the drum itself.

The aim of the present disclosure consists in providing a centrifugal separator that compensates for at least one of the above mentioned drawbacks and overcomes the limitations of the known art.

Within this aim, an object of the present disclosure is to provide a centrifugal separator the maintenance and cleaning of which are particularly rapid and effective.

Another object of the disclosure consists in providing a centrifugal separator that is capable of offering the widest guarantee of reliability and safety in use, and which is easy to provide and economically competitive when compared to the known art.

This aim and these and other objects which will become better apparent hereinafter are all achieved by a centrifugal separator according to claim 1.

Further characteristics and advantages of the disclosure will become better apparent from the detailed description of a preferred, but not exclusive, embodiment of a centrifugal separator, illustrated for the purposes of non-limiting example with the assistance of the accompanying drawings wherein.

Figure 1:
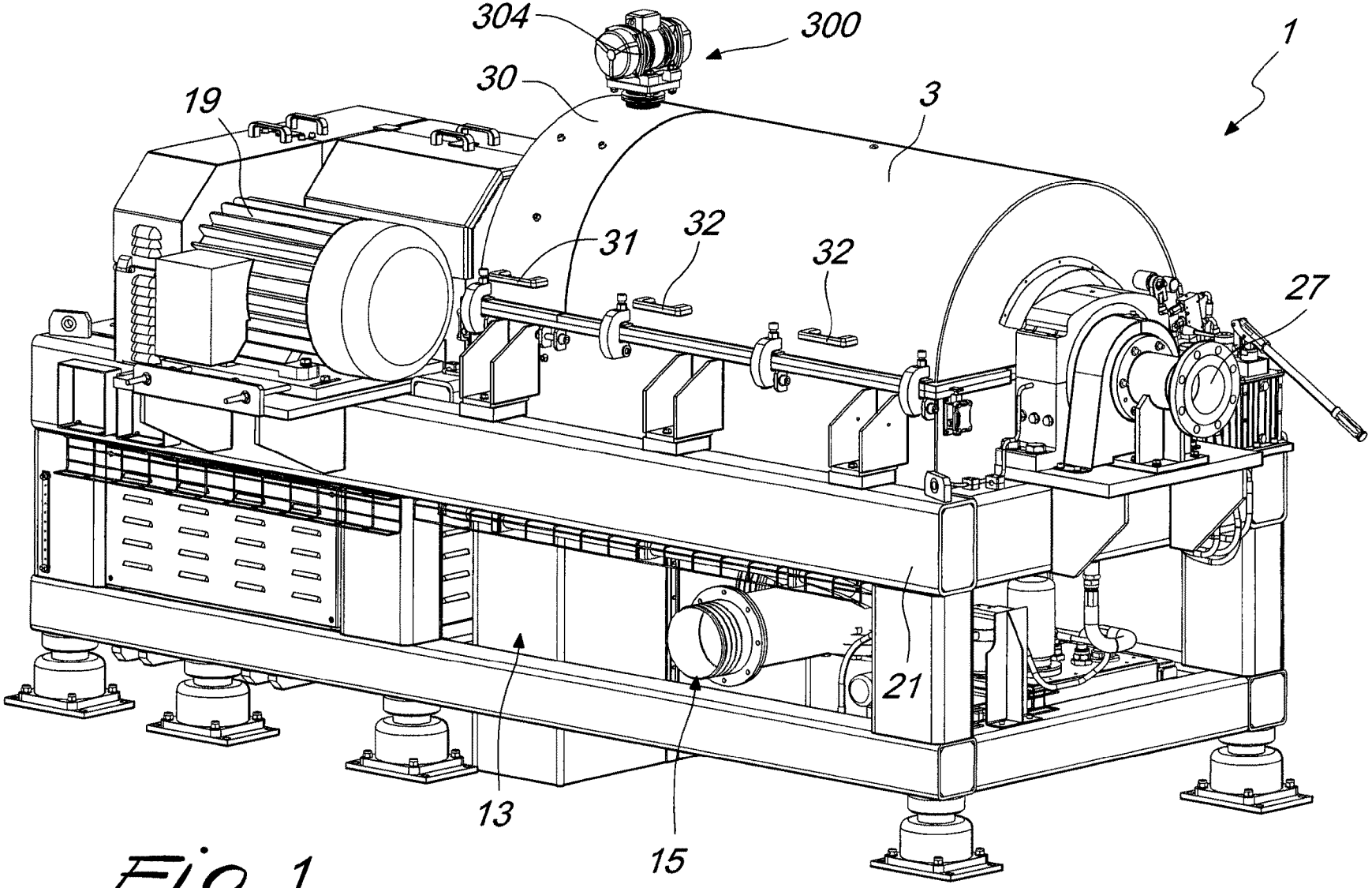
FIG. 1 is a perspective view of an embodiment of a centrifugal separator.
Figure 2:
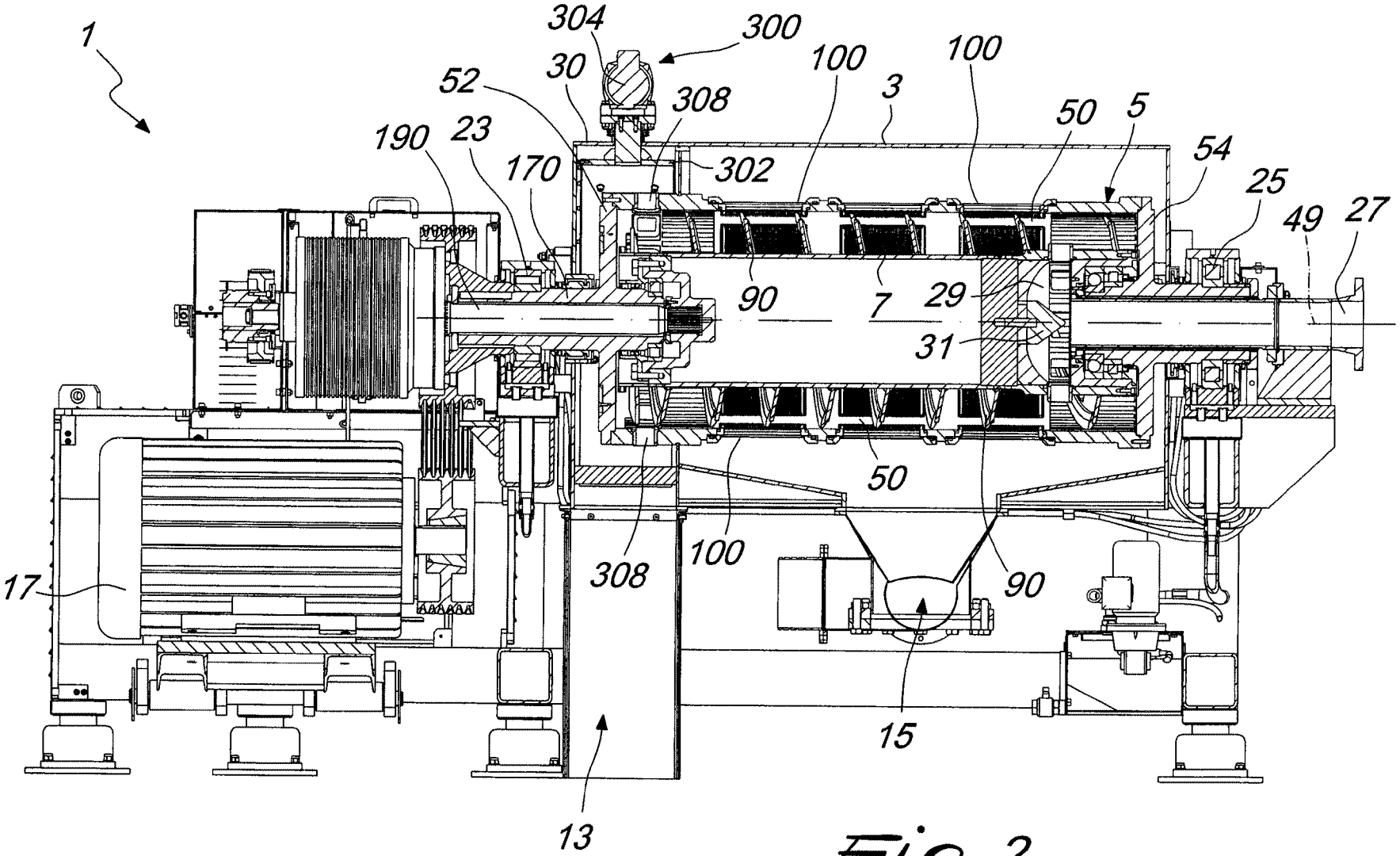
FIG. 2 is a sectional side view of the centrifugal separator shown in FIG. 1.
Figure 3:
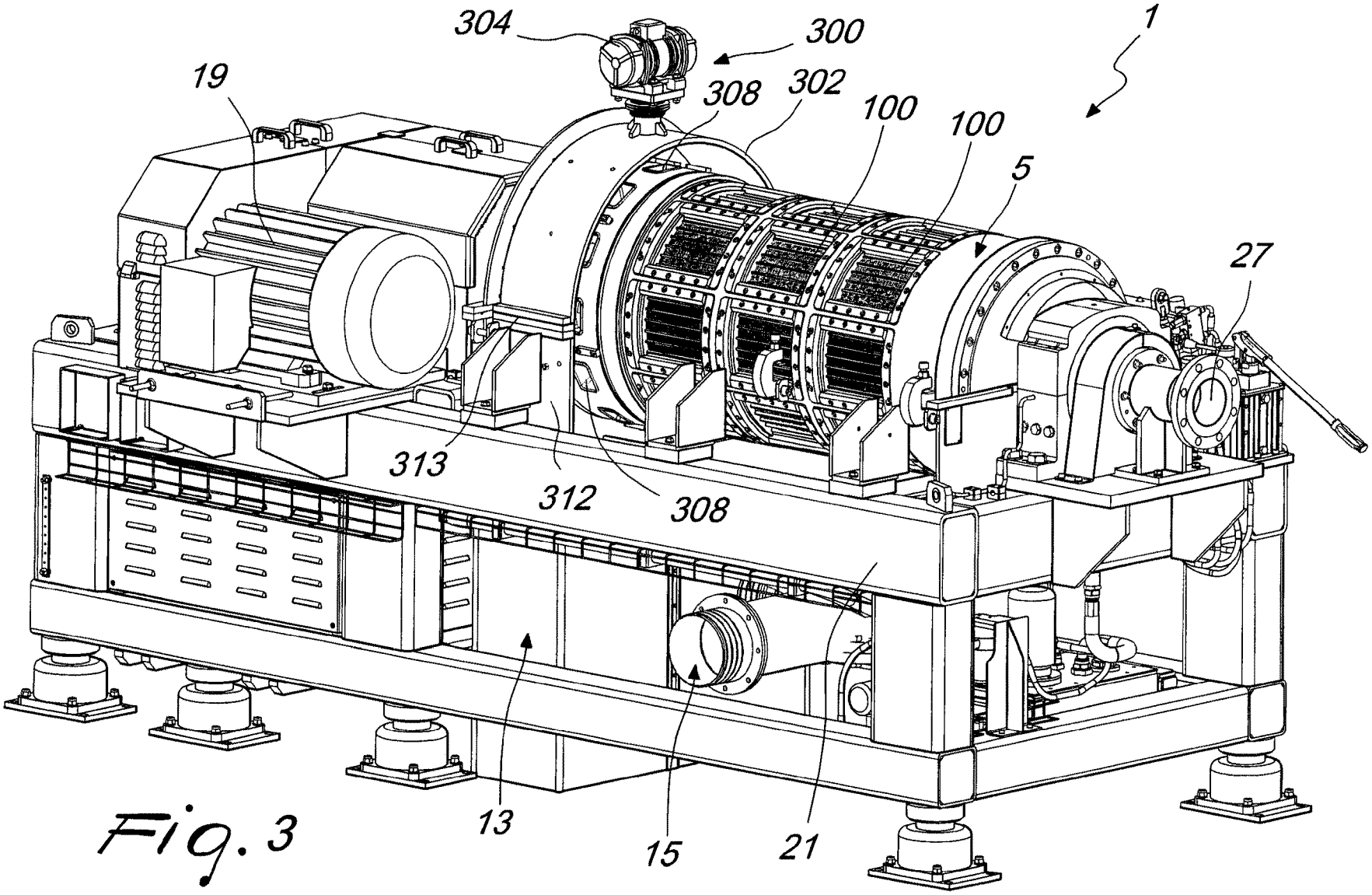
FIG. 3 is a perspective view of the centrifugal separator shown in FIG. 1, from which the outer casing has been removed.
Figure 4:
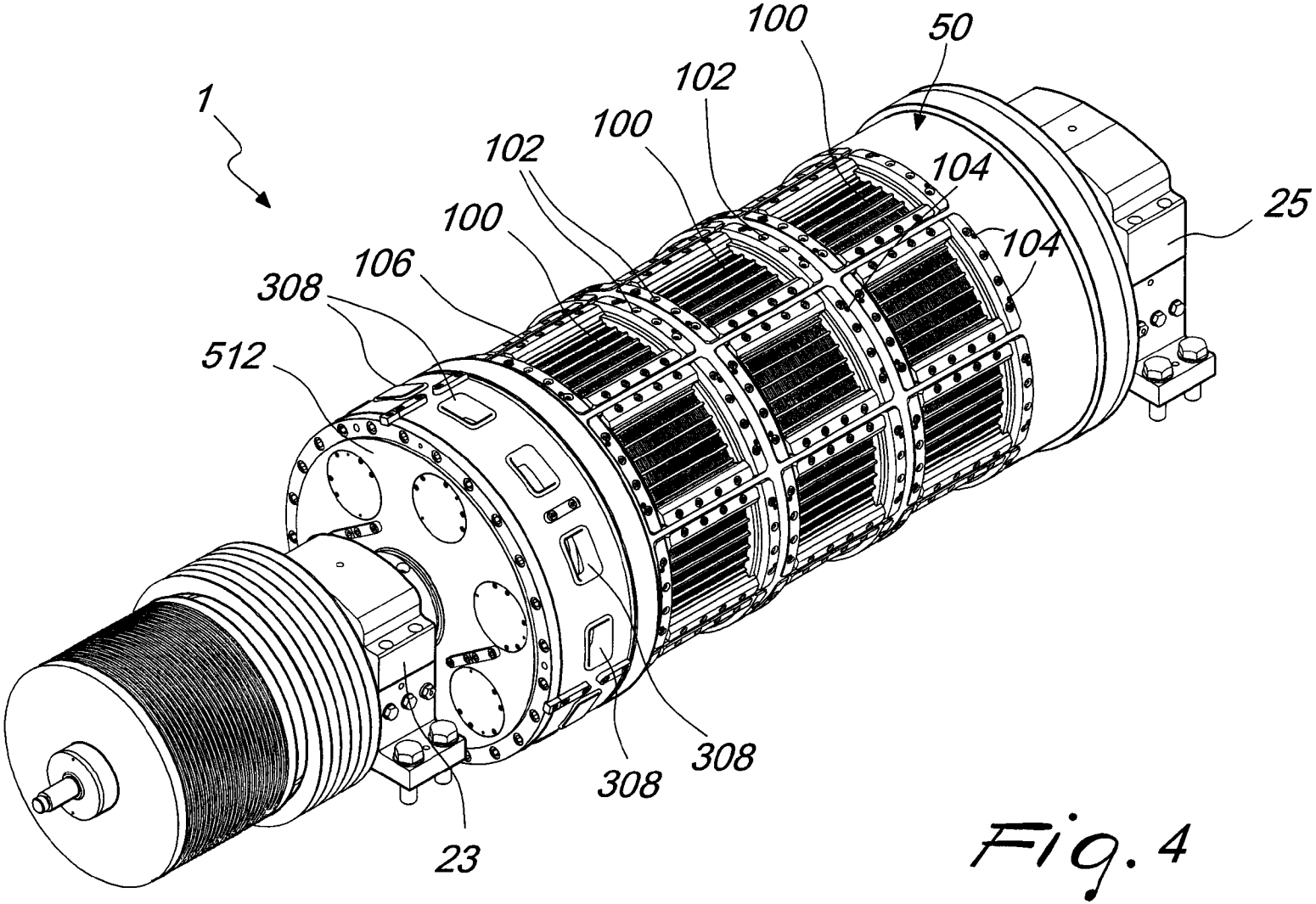
FIG. 4 is a perspective view of the rotatable drum of the centrifugal separator, supported at the ends and provided with a reduction gear assembly.
Figure 5:
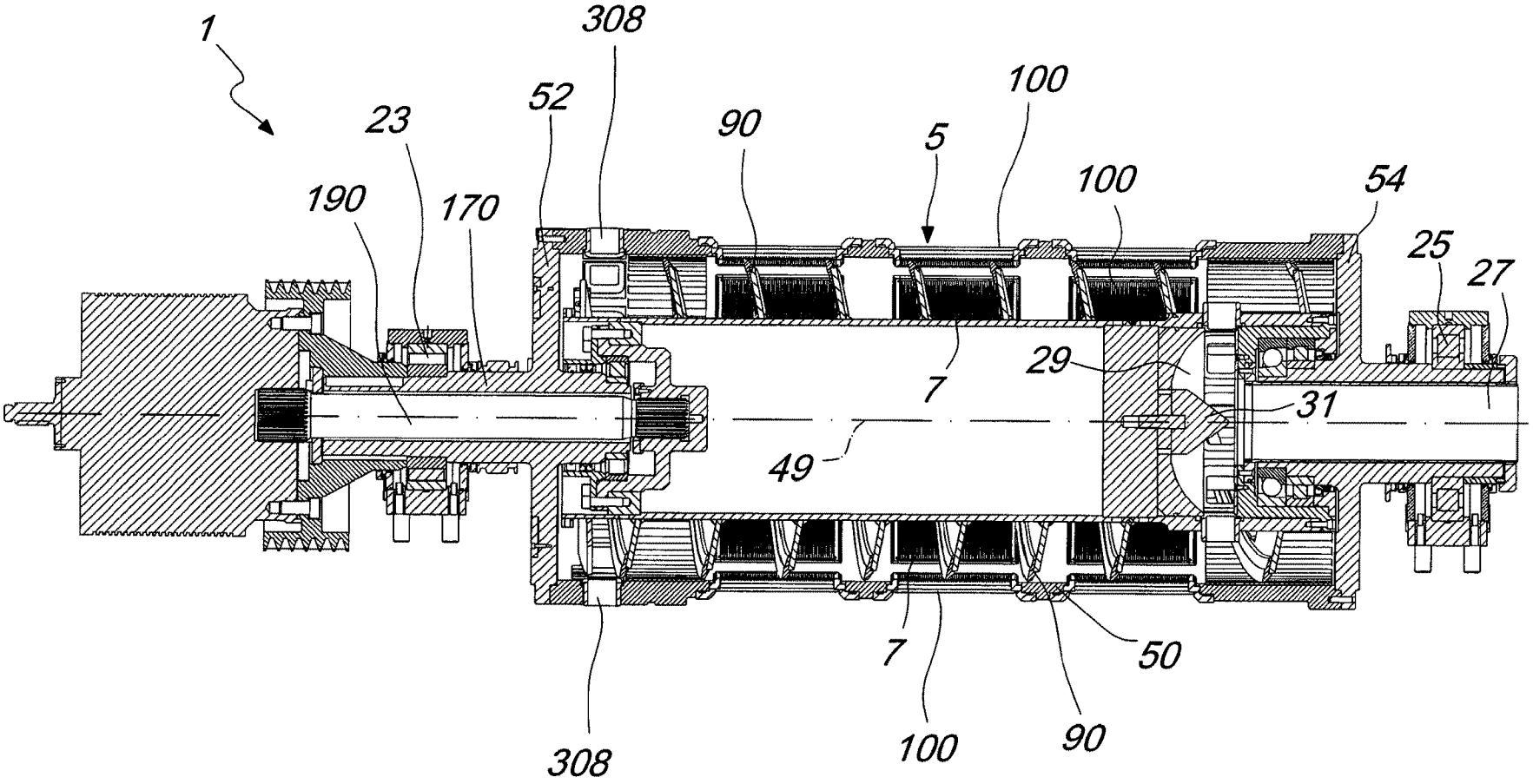
FIG. 5 is a sectional side view of the rotatable drum shown in FIG. 4.
Figure 6:
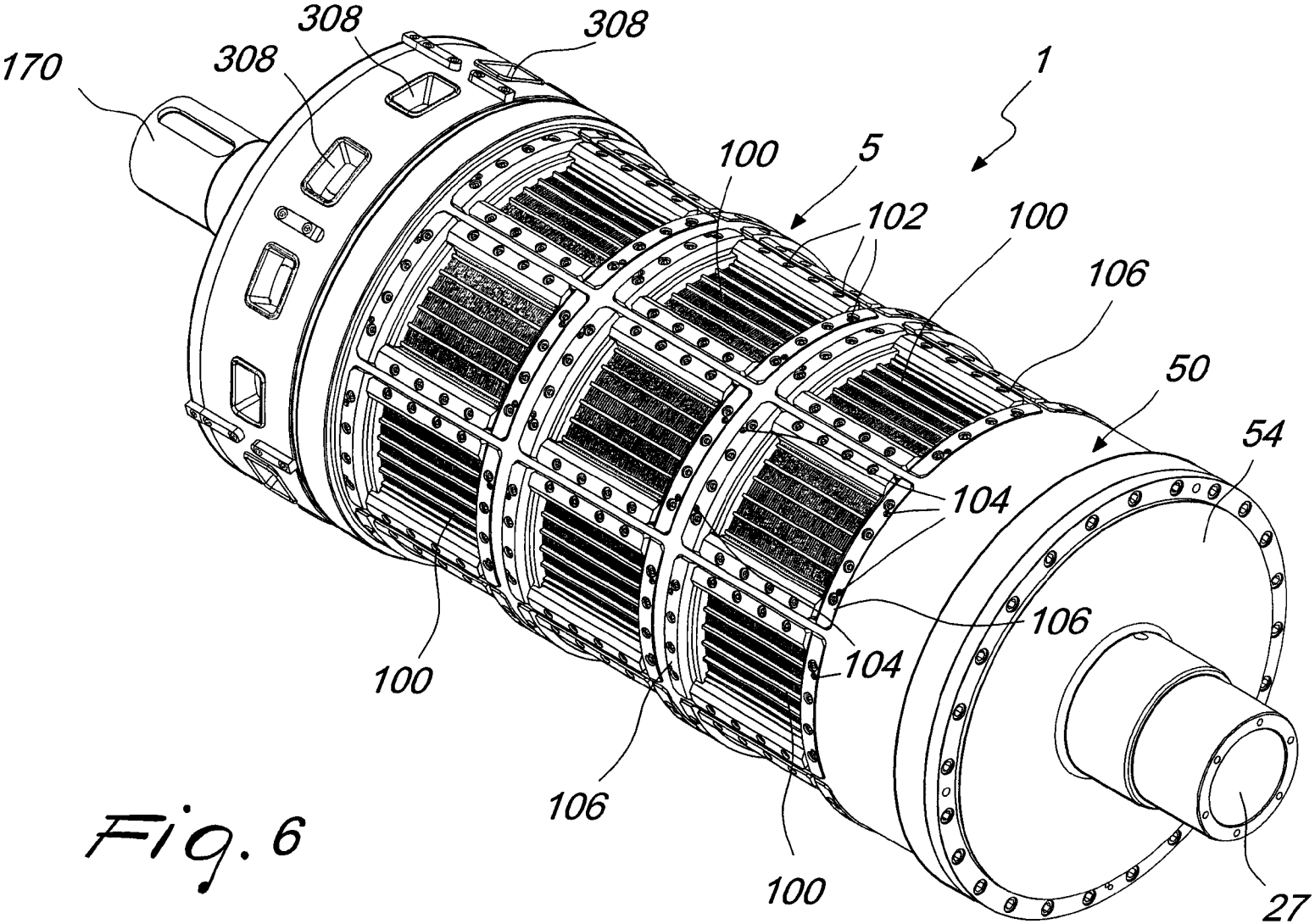
FIG. 6 is a perspective view of the rotatable drum of the centrifugal separator.
Figure 7:
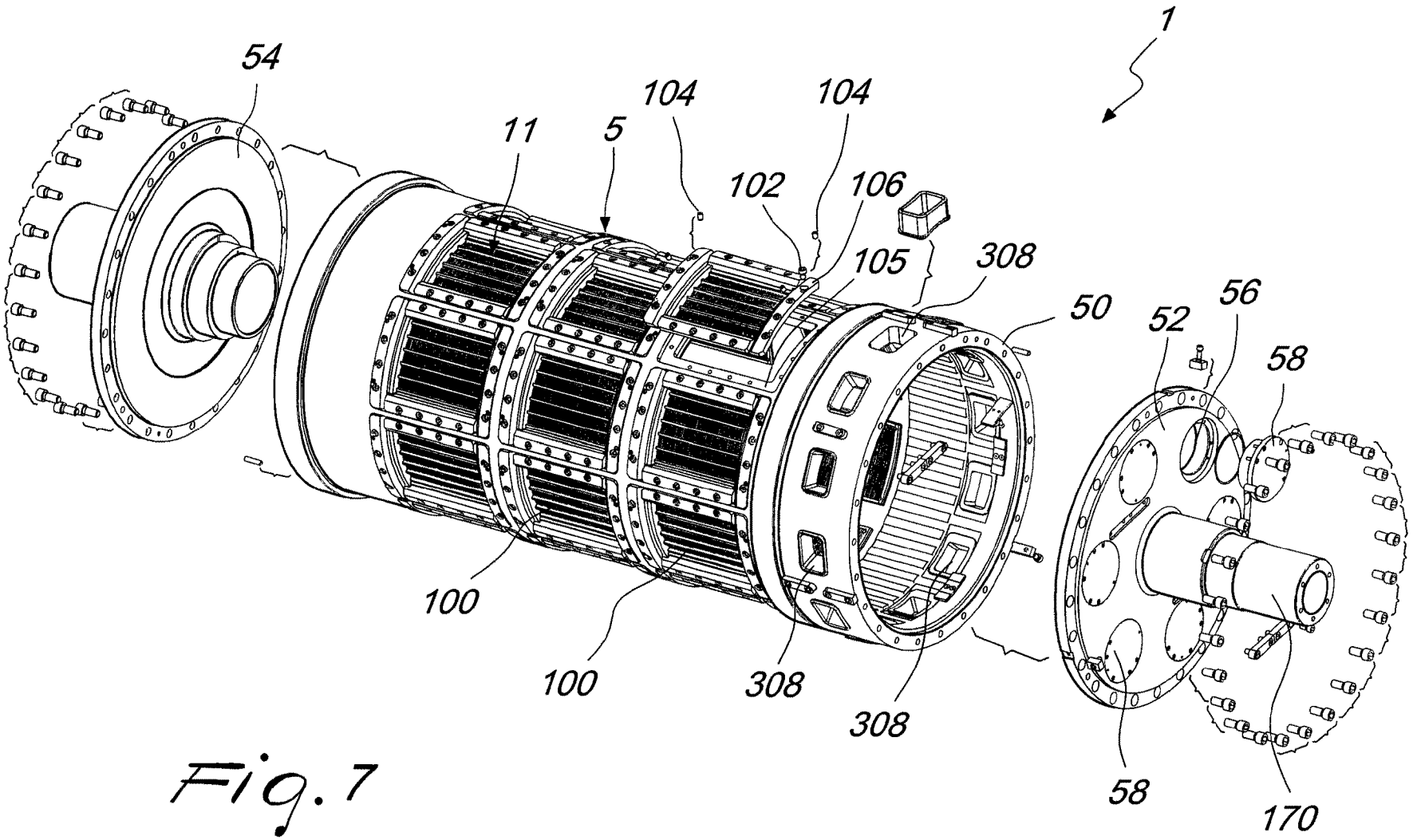
FIG. 7 is an exploded perspective view of the rotatable drum shown in FIG. 6.
Figure 8:
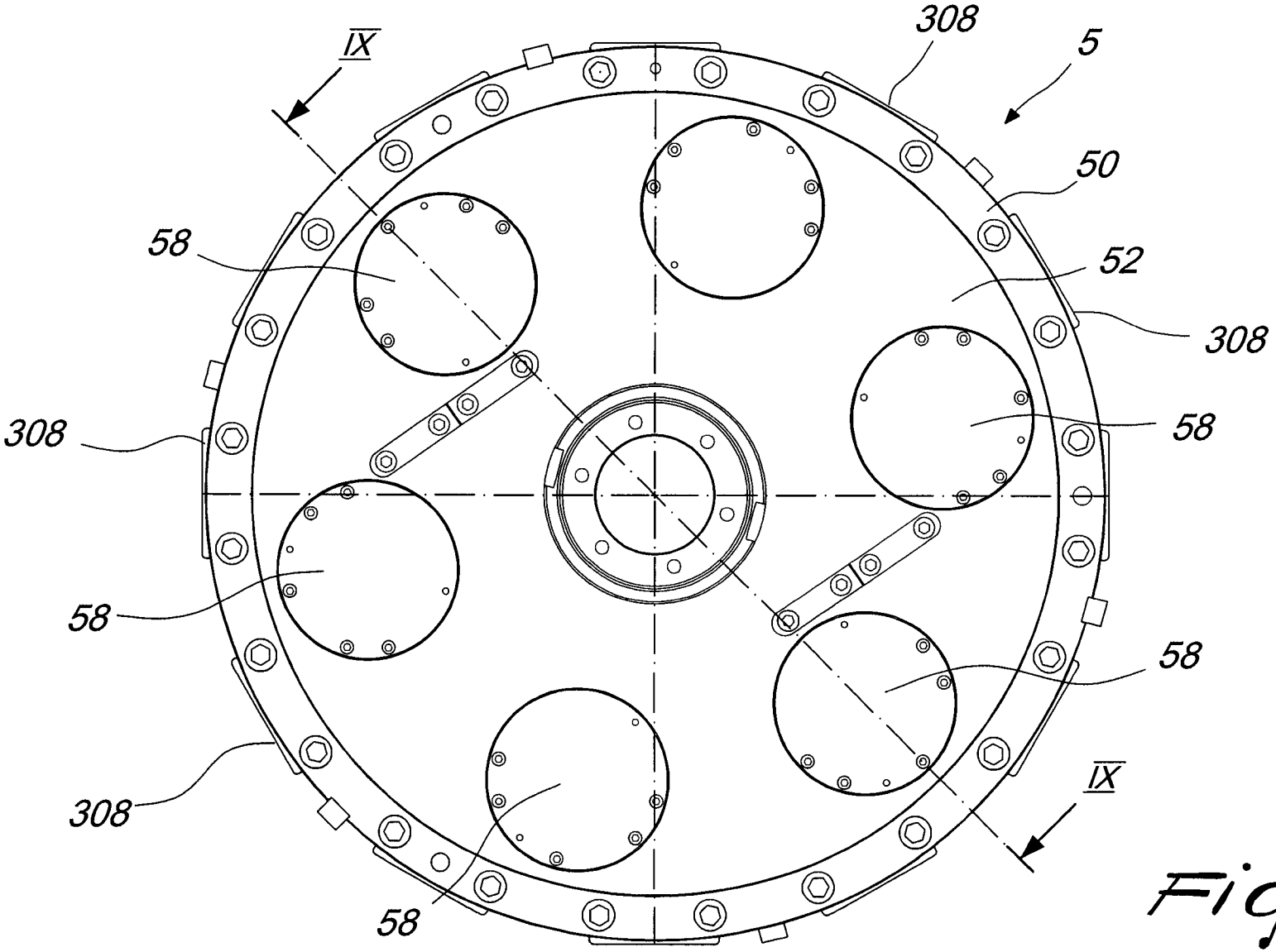
FIG. 8 is a front elevation view of the rotatable drum shown in FIG. 6.
Figure 9:
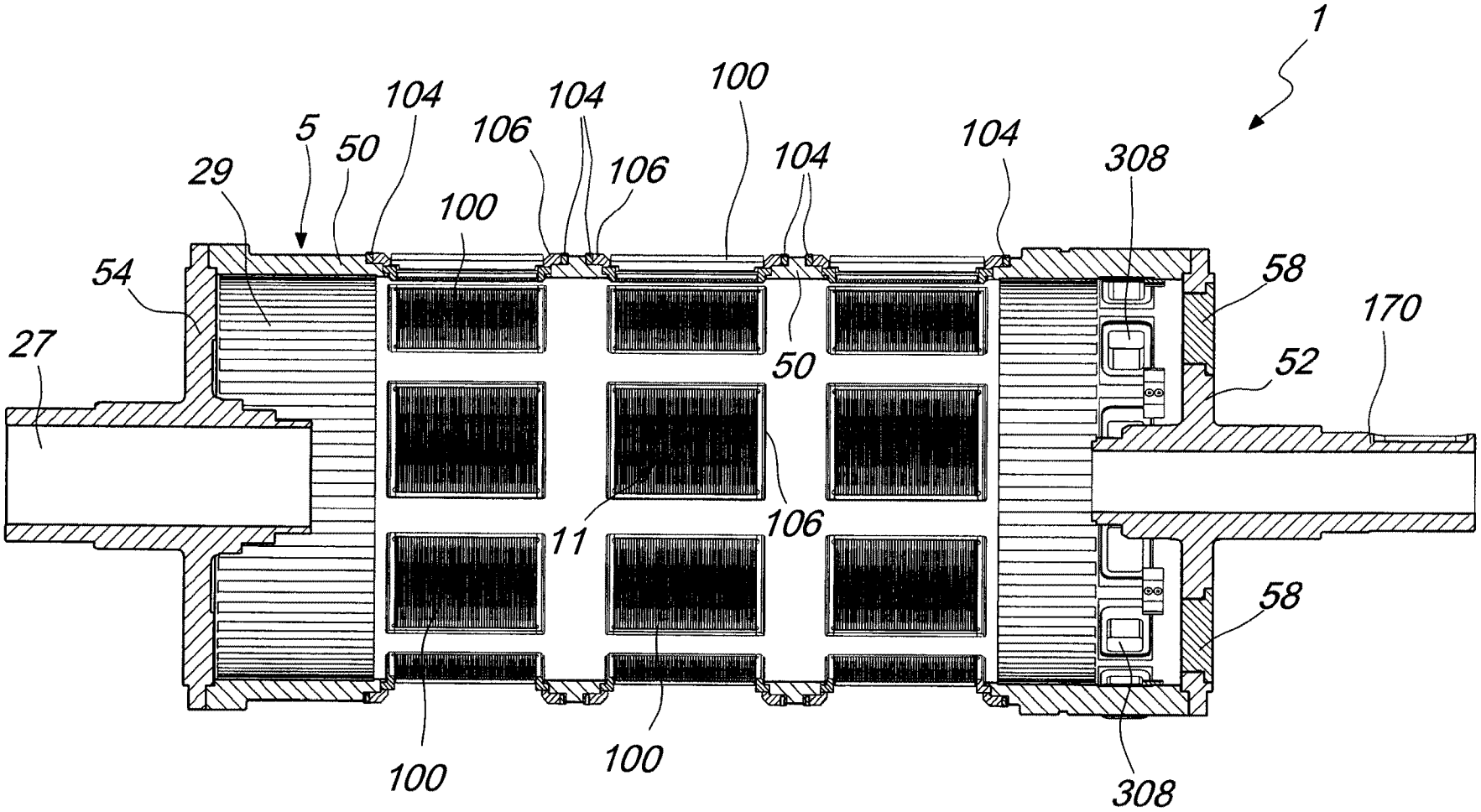
FIG. 9 is a sectional view of the rotatable drum shown in FIG. 8, taken along the line IX-IX.

With reference to the figures, the centrifugal separator, generally designated by the reference numeral 1, comprises:

- a rotatable drum 5 having a wall 50,
- an annular chamber 7 defined along the longitudinal axis 49 of the rotatable drum 5 and bordering the wall 50,
- an annular screw feeder 90, accommodated rotatably in the annular chamber 7, for moving a mixture of substances in the liquid phase and in the solid phase, longitudinally through the annular chamber 7, and
- separation nets 100, or screens, arranged in the wall 50 of the rotatable drum 5, which have meshes for filtering the solid phase of the mixture of substances from the liquid phase, by rotation of the rotatable drum 5.

In particular, the annular chamber 7 is arranged inside the rotatable drum 5, adjacent to the wall 50, so that the wall 50, together with the separation nets 100, forms the external wall of the annular chamber 7.

The separation nets 100 are preferably movable relative to the wall 50 of the rotatable drum 5.

The centrifugal separator may further comprise adjusting members 104 for regulating the radial position of the separation nets 100 relative to the wall 50 of the rotatable drum 5.

The adjusting members 104 may be independently adjustable for regulating the inclinations of the separation nets 100 relative to the wall 50 of the rotatable drum 5. In case of uneven wear of the inner surface of the separation nets 100 and/or of the outer portion of the annular screw feeder 90, the regulation of the inclinations of the separation nets 100 relative to the wall 50 can guarantee that the annular screw feeder 90 keeps brushing, during rotation or keeps rotating at a controlled distance, the inner surface of the separation nets 100 without mechanically interfering with it.

The separation nets 100 preferably comprise a supporting frame 106 accommodated in a slot, or opening, 105 arranged in the wall 50 of the drum 5, so that the separation nets 100 can be moved in the slot 105, relative to the wall 50, by operating on the supporting frame 106.

The separation nets 100 have a slightly curved shaped, so as to be correctly arranged in the wall 50 of the drum 5 in order to adapt to the curved shape of the drum 5.

According to the embodiment of the centrifugal separator 1, illustrated in the drawings, the adjusting members 104 may comprise at least four grub screws arranged proximate to the corners of the supporting frame 106, and screwable independently of each other for regulating both the radial position and the inclinations of the supporting frame 106 relative to the wall 50 of the drum 5.

Figure 10:
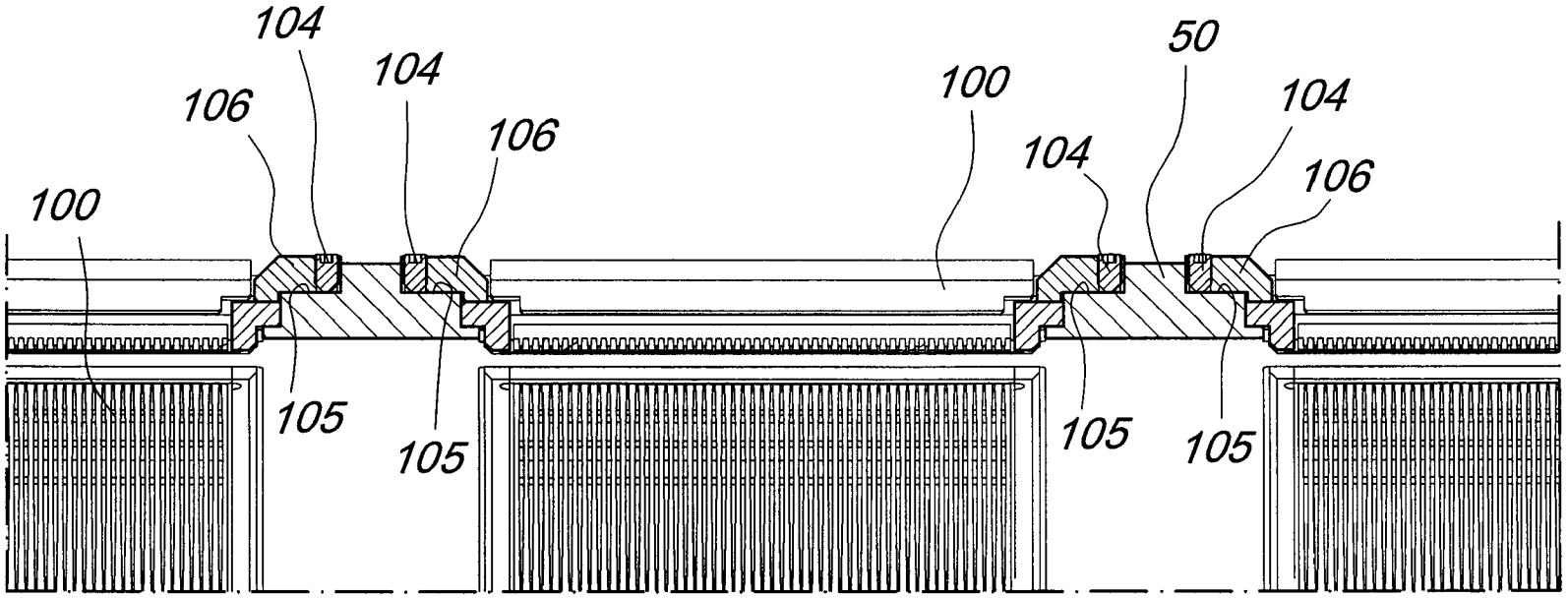
FIG. 10 is an enlarged view of a detail in FIG. 9.
Figure 11:
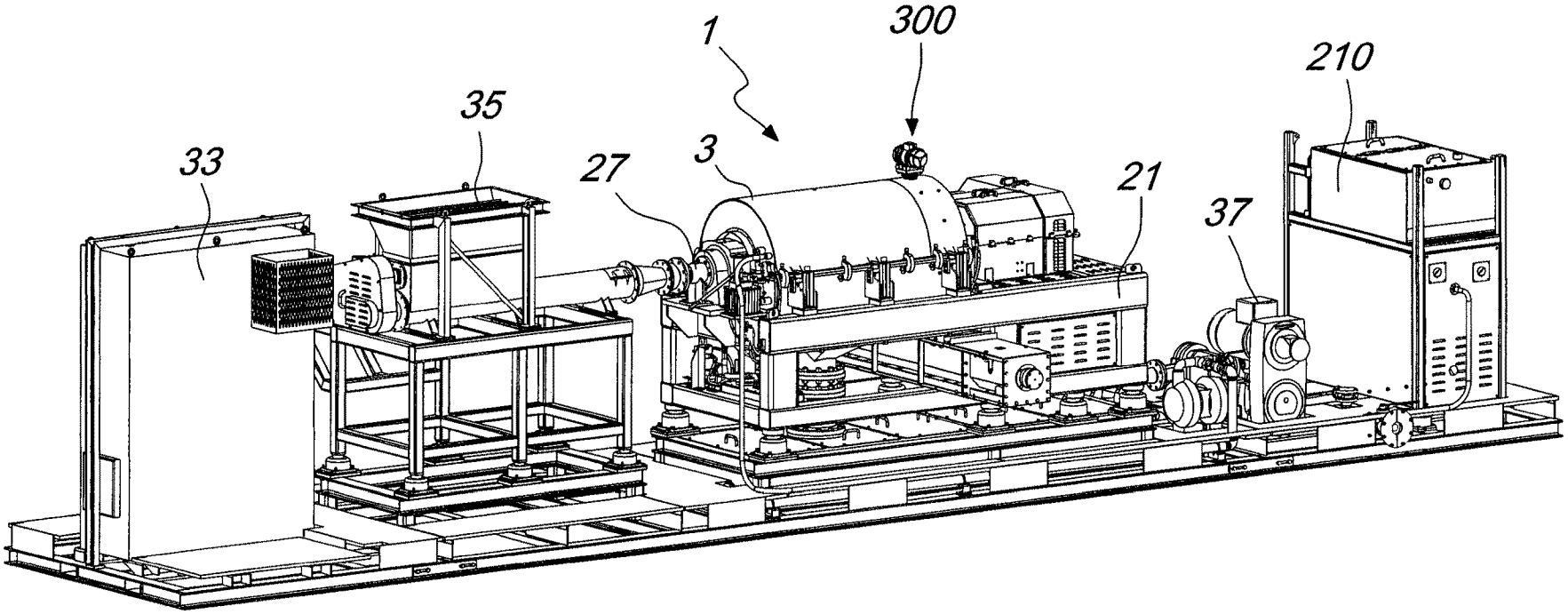
FIG. 11 is a perspective view of a station for the treatment of muds, which comprises a centrifugal separator.
Figure 12:
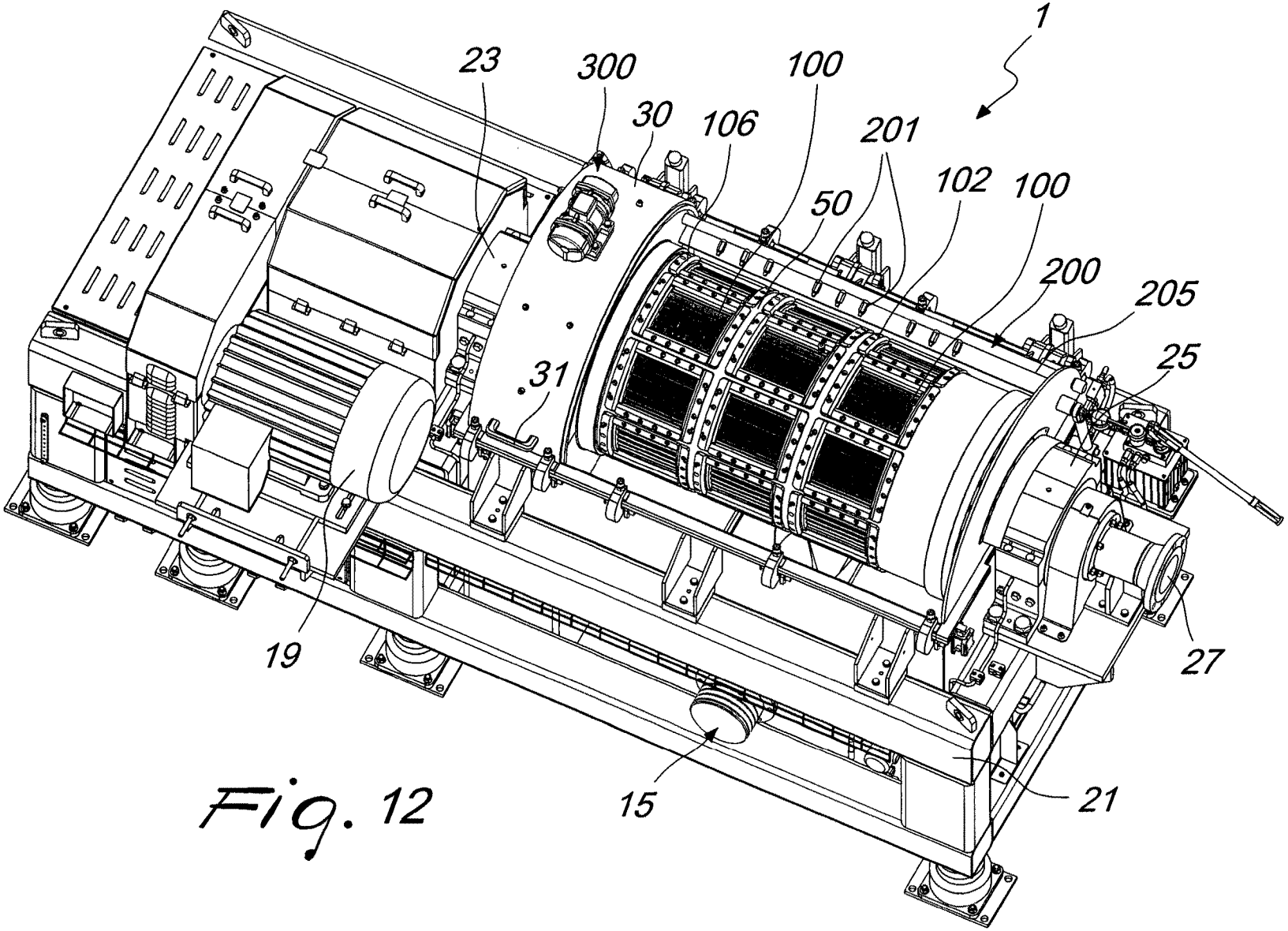
FIG. 12 is a perspective view of a centrifugal separator, shown without the outer casing and comprising a cleaning system.
Figure 13:
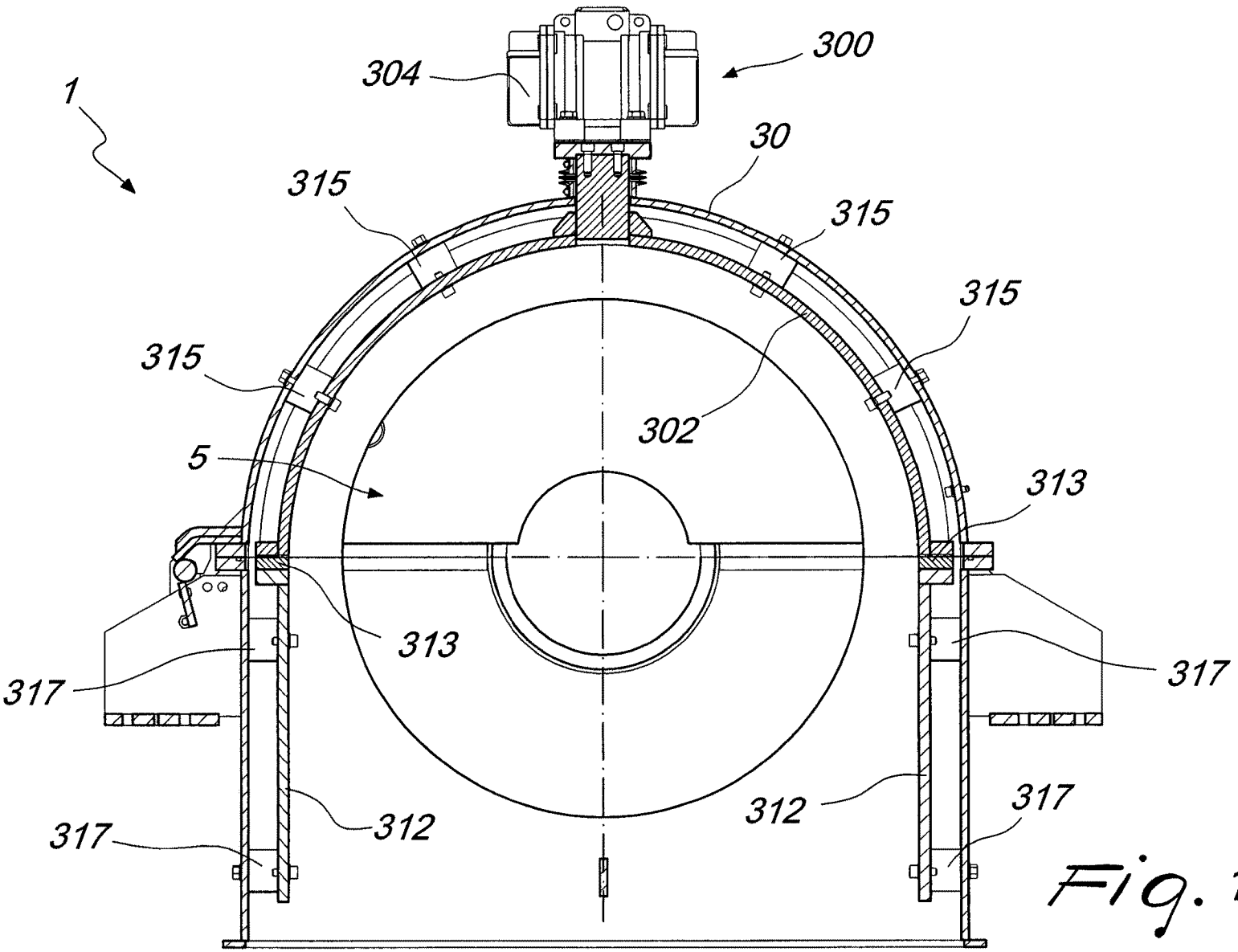
FIG. 13 is a front sectional view of a part of a centrifugal separator, showing in particular some of the components that define the station for discharging the solid phase.
Figure 14:
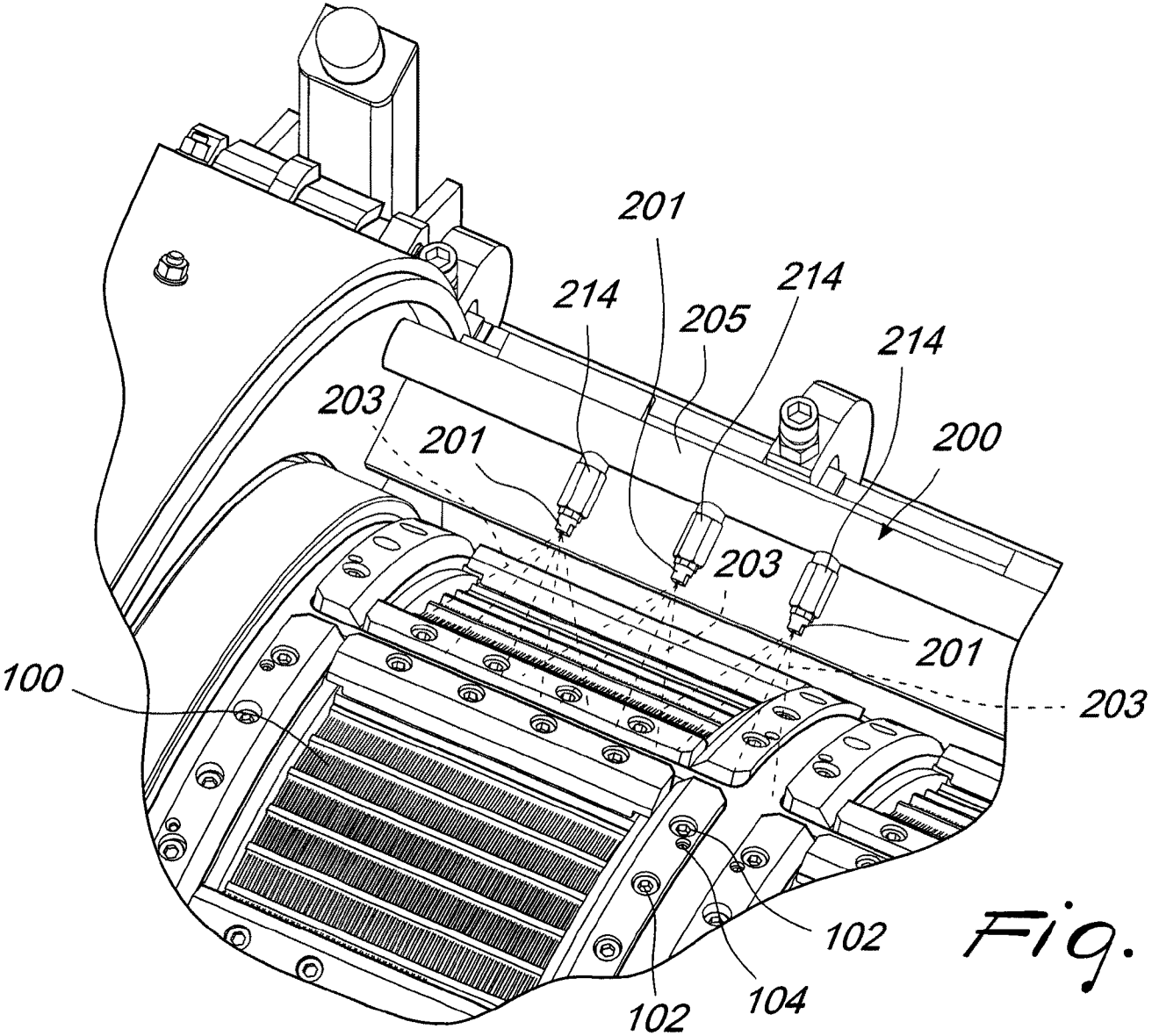
FIG. 14 is an enlarged view of a detail in FIG. 12.

FIG. 10 shows a sectional view of a separation net 100 supported by the supporting frame 106 inserted in the slot 105 of the wall 50. The grub screws 104 allows both to move the supporting frame 106 relative to the wall 50 in the radial direction, i.e. concentrically with respect to the wall 50, and to slightly incline the supporting frame 106 with respect to the surface defined by the wall 50 in all directions. The separation net 100 can therefore be slightly inclined with respect to the longitudinal axis 49 and/or with respect to the radial direction.

The annular screw feeder 90 is preferably configured to brush against the inner surface of the separation nets 100 without mechanically interfering with it, even in the event of uneven wear or unforeseeable mechanical play, thanks to the adjustability of the radial position and of the inclinations of the separation nets 100 relative to the wall 50 of the drum 5, as described above.

Preferably, the radial distance between the separation nets 100 and the annular screw feeder 90 in rotation can be regulated to be in the range between 0.1 mm and 2 mm, and preferably in the range between 0.1 mm and 1 mm. This range ensures a sufficient margin between the components that can move with respect to each other, i.e. the rotatable drum 5, together with the separation nets 100, and the annular screw feeder 90, while at the same time also making it possible to push forward the mixture which tends to accumulate, owing to the centrifugal force, in the furthest outward annulus inside the annular chamber 7.

The rotatable drum 5 may be substantially cylindrical and may rotate about a substantially horizontal rotation axis 49. The cylindrical configuration of the wall 50 of the drum 5 results in a constant centrifugal force being generated in the annular chamber 7 along the entire longitudinal axis 49, as a function of the rotation speed of the rotatable drum 5.

The separation nets 100, which can have meshes having openings of average diameter comprised indicatively between 0.04 mm and 4 mm, can be arranged in the wall 50 so as to cover substantially and/or partially at least the central portion of the rotatable drum 5. In other words, the separation nets 100 can be distributed longitudinally and circumferentially in the wall 50 of the drum 5, in order to cover in a substantially uniform manner at least the central portion of the wall 50. Preferably such separation nets 100 cover all of the wall 50 of the drum 5, with the exception of the two longitudinal end portions of the drum 5, respectively where the mixture is introduced, and where the discharged solid phase is collected, i.e. at the discharge station 13 for discharging the solid phase.

According to the operational performance required, one or more of the separation nets 100 can also be substituted by blind plates designed to be inserted in the slots 105 of the wall 50 of the drum 5. Such blind plates can be equipped by adjusting members and supporting frames, such as the adjusting members 104 and the supporting frames 106 previously described with regard to the separation nets 100.

Each separation net 100 may further comprise fixing elements 102 for fixing the separation nets 100 to the wall 50 of the drum 5. The fixing elements 102 are preferably accessible from outside the drum 5 for the removal and substitution of the separation nets 100, once the outer casing 3, which accommodates the rotatable drum 5, is open. The casing 3 can be lifted by means of the handles 32.

The fixing elements 102 can comprise a plurality of screws, which are arranged perimetrically around the separation nets 100, for example all around the supporting frame 106.

Furthermore, the dimension of the openings of the mesh of at least one separation net 100 can be different from the dimensions of the openings of the meshes of the remaining separation nets 100. In other words, one or more separation nets 100 can have meshes with larger, or smaller, openings.

Preferably, the separation nets 100 have meshes having openings of gradually increasing or decreasing dimensions, relative to the longitudinal axis 49.

In particular, along the longitudinal axis 49 of the drum 5, separation nets 100 can be arranged with meshes having openings of gradually decreasing dimensions, so as to filter an increasingly fine solid phase, as the mixture is pushed forward by the rotation of the annular screw feeder 90.

Preferably, each separation net 100 has a mesh having openings of substantially identical dimensions, but the dimension of the openings of the meshes can vary from one separation net 100 to another.

The separation nets 100 can have different configurations of wire meshes, or they can be made of different kinds of perforated materials. The opening or size of the meshes of the separation nets 100 may be elongated, and it may have a larger dimension which extends in a chosen direction relative to the longitudinal axis 49 of the drum 5. For example, it may extend transversely with respect to the longitudinal axis 49. For example, the openings of the meshes can have a substantially rectangular configuration, where the long side is arranged in a direction that is substantially perpendicular to the longitudinal axis 49 of the drum 5. In this manner the combined action of the filtering of the separation nets 100 owing to the centrifugal effect, and the longitudinal movement of the material along the direction of extension of the annular chamber 7 imposed by the rotation of the annular screw feeder 90, is particularly effective.

The centrifugal separator 1 can comprise first motor means 17 for actuating the rotation of the drum 5 and, either through direct or transmitted drives, by way of a reduction gear, for actuating the rotation of the annular screw feeder 90. Preferably, as in the example shown in the figures, second motor means 19 are provided for defining or adjusting the difference in rotation speed between the drum 5 and the screw feeder 90. First motor means 17 and second motor means 19 can be electric motors or hydraulic driven motors.

In a variation, which is not shown, the first motor means 17 and the second motor means 19 can be used to actuate respectively the drum 5 and the screw feeder 90, so as to have two independent actuation systems.

Furthermore, the centrifugal separator 1 can comprise a first speed variator for the first motor means 17 and a second speed variator for the second motor means 19. In this manner it is possible to adjust the rotation speed of the drum 5 and of the annular screw feeder 90 and the difference between the two speeds, respectively. Therefore it is possible not only to vary the strength of the centrifugal force obtained by virtue of the rotation of the drum 5, but also to vary the speed of longitudinal movement of the mixture inside the annular chamber 7, for example as a function of the plasticity of the drilling muds that make up the mixture itself, or as a function of the different solid component with respect to the liquid component of the mixture.

The centrifugal separator 1 can comprise a management and control unit 33 which is adapted to the management and control, automatically or by an operator, of the actuation of the first motor means 17, of the second motor means 19 and of the speed variators.

The centrifugal separator 1 may comprise a first transmission shaft 170, for transmission of the rotation from the first motor means 17 to the rotatable drum 5, and a second transmission shaft 190, for transmission of the rotation from the reduction gear to the annular screw feeder 90. The second transmission shaft 190 is preferably coaxial to the first transmission shaft 170.

Furthermore, the first transmission shaft 170 is advantageously hollow, so that the second transmission shaft 190 can be at least partially inserted into the first transmission shaft 170.

At least one of the bases 52 and 54 of the rotatable drum 5 may comprise at least one discharge opening 56 which can be closed by a detachable cover 58, for discharging the excess liquid phase or the excess solid phase of the mixture. In particular, a plurality of discharge openings 56 can be provided with covers 58. The removal of the covers 58 is particularly advantageous in the treatment of drilling fluids the liquid phase of which is predominant with respect to the solid phase, such as for example for "solids control" techniques, but also for waste fluid treatment. Discharge openings 56 at base 52 are designed to discharge the excess liquid phase, while discharge openings 56 at base 54 are designed to discharge also the excess solid phase. Covers 58 can be also partially opened, or replaced with covers which are partially open, so as to influence the overflow height of the drum 5.

The centrifugal separator 1 may comprise a chassis 21. The drum 5 is preferably supported, at its longitudinal ends, by rolling bearings 23 and 25, which can be supported by the chassis 21.

The centrifugal separator 1 may comprise a channel 27 for feeding the mixture, communicating with a feeding chamber 29 which is defined in one end of the rotatable drum 5. The feeding chamber 29 may comprise a deflector cone 31 which is adapted to deviate the flow of the mixture originating from the feeding channel 27 toward the annular chamber 7, in cooperation with the centrifugal effect owing to the rotation of the drum 5 itself. The feeding channel 27 is fed by a station 35 for feeding the mixture to be processed.

The liquid phase of the mixture, which is recovered in the discharging station 15, substantially freed from the solid phase, can then be recovered using the intake pump 37, for subsequent disposal, secondary treatment, or reuse.

The centrifugal separator 1 may further comprises a system 200 for cleaning the separation nets 100, which comprises a plurality of nozzles 201 which are adapted to generate a jet 203 of a cleaning liquid.

Such pressure is preferably higher than 50 bar, and preferably comprised in a range between 110 and 130 bar.

In particular, the jets 203 of cleaning liquid strike the separation nets 100, from outside the drum 5, in a direction that is substantially perpendicular to the separation net 100 itself. The angles of the nozzles 201 relative to the drum 5 can be adjustable, so as to conveniently orient the jets 203 of cleaning liquid. Furthermore, if the separation nets 100 are distributed longitudinally and circumferentially in the wall 50 of the drum 5 so as to cover at least the central portion thereof in a substantially uniform manner, the nozzles 201 are preferably distributed along a line 205, outside the drum 5, parallel to the wall 50 of the drum 5, preferably so as to strike the separation nets 100 along all of their length. In this manner the rotation of the drum 5 determines the cleaning of all the separation nets 100.

The centrifugal separator 1 can further comprise a high pressure pump 210 for feeding the cleaning system 200 with the above mentioned cleaning liquid, and can comprise means of adjustment and control of the pressure of the cleaning liquid, which can be comprised in the management and control unit 33 of the centrifugal separator 1.

The nozzles 201 advantageously comprise spacers 214 for adjusting the distance of the nozzles 201 from the separation net 100.

The nozzles 201 can be fan-shaped nozzles, and the jet 203 can lie on a plane that passes through the longitudinal axis 49 of the rotatable drum 5. In this manner the jet 203 is substantially perpendicular to the long side of the openings of the meshes of the rectangular separation nets 100. Consequently, the rotation of the drum 5 in fact involves sliding each rectangular filtering mesh under the jet 203.

The method for cleaning the centrifugal separator 1 comprises the steps of: temporarily interrupting the feeding of the mixture into the annular chamber 7, maintaining the rotatable drum 5 in rotation, optionally at a reduced rotation speed, and actuating the cleaning system 200 in order to dispense the jets 203 of the cleaning liquid. In this manner the solid phase that blocks up, even only partially, the separation nets 100 is pushed again toward the center of the annular chamber 7 in order to be pushed once again toward the discharging station 13 from the annular screw feeder 90.

The discharging station 13 of the centrifugal separator 1, for discharging the solid phase, may comprise a vibrating or pulsating unit 300 for agitating the solid phase, which comprises a half-drum 302, for shaking out the solid phase at its point of exit from the rotatable drum 5, and a vibrating device 304 which is adapted to vibrate the half-drum 302.

The half-drum 302 is preferably arranged concentrically and in an upper region with respect to the rotatable drum 5, and is preferably provided in a material of the type of anti-corrosion and anti-abrasion materials, for example stainless steel.

The half-drum 302 may have a semicircular configuration, and can comprise, at its ends, two extension elements 312, in the same material of the half-drum 302 (for example stainless steel) which are adapted to define containment walls of the station 13 for discharging the solid phase. Such extension elements 312 can be connected to the ends of the half-drum 302 by way of shims 313 which are adapted to allow the transmission, at least partially, of the vibration from the half-drum 302 to the extension elements 312.

The vibrating device 304 can be a pneumatic actuator, an hydraulic actuator, or an electrical actuator with eccentric masses.

In an embodiment, the casing 3 encloses the rotatable drum 5, annular chamber 7 and the half-drum 302 therein, and the vibrating device 304 is uncovered and provided outside the casing 3 of the centrifugal separator 1 and above the half-drum 302.

The vibrating unit 300 may further comprise drum shock absorbers 315 and shock absorbers 317 for the extension elements 312, which are made of a material of the type of rubber. In particular, the half-drum 302, and the extension elements 312 can each comprise at least one shock absorber 315 and 317 which couples them to a portion 30 of the casing 3 of the centrifugal separator 1, while allowing the vibration thereof. The half-drum 302 preferably comprises six drum shock absorbers 315, while each extension element 312 preferably comprises four shock absorbers 317.

The portion 30 of the casing 3 may be openable, for example by means of a handle 31, for accessing the half-drum 302.

The wall 50 of the rotatable drum 5 may comprise, at the station 13 for discharging the solid phase, at least one outlet 308, made of a wear-resistant material (for example tungsten carbide), for discharging the solid phase, which faces, during the rotation of the drum 5, the half-drum 302.

In particular, such wall 50 can comprise a plurality of outlets 308 for discharging the solid phase, a portion of which faces, during the rotation of the drum 5, the half-drum 302. Such discharge outlets 308 are preferably distributed, at the discharging station 13, substantially around the entire circumference of the wall 50 of the drum 5.

The centrifugal separator 1 is adapted to treat various types of mixtures of substances in the liquid and solid phase, such as, for example, water-based drilling muds, oil-based drilling muds, waste slops, and materials resulting from mining and tunnelling operations.

The operation of the centrifugal separator 1 is clear and evident from the foregoing description.

In particular, the mixture in the liquid phase and in the solid phase originating from the feeding station 35 passes through the feeding channel 27, by free flowing, by way of pushing under pressure or by way of a circular screw feeder inside the channel 27 itself, and is introduced into the feeding chamber 29 of the rotatable drum 5. Here, owing to the centrifugal force from the rotation of the drum 5 and owing to the deviation action of the deflector cone 31, the mixture is pushed radially toward the wall 50 of the drum 5, reaching the annular chamber 7, and thanks to the action of the annular screw feeder 90 it is pushed longitudinally along the annular chamber 7. The feed flow of the mixture can be regulated, manually and/or automatically through the control panel of the management and control unit 33. In addition, when a condition of over-torque arises in the rotatable drum 5, the feed flow of the mixture can be safely restricted or interrupted, manually and/or automatically through the control panel of the management and control unit 33.

The centrifugal rotation of the drum 5 generates a radial force that acts outwardly on the mixture and, thanks to the presence of the separation nets 100, the liquid phase (i.e. the shearing fluid phase and solid particles smaller than the meshes dimension) is expelled from the annular chamber 7, separating from the solid phase, and is then collected in the discharging station 15, where it is later recovered, for example using the intake pump 37.

In the meantime the mixture, which is increasingly richer in solid components, and poorer in liquid components, continues its journey along the annular chamber 7, until it arrives at the station 13 for discharging the solid phase. At the discharging station 13, the drum 5 comprises the plurality of discharge outlets 308 through which the solid phase of the mixture, now sufficiently free of the liquid phase is expelled, again owing to the centrifugal effect combined with the separation effect provided by the separation nets.

The vibrating unit 300 prevents the solid phase from accumulating around the rotatable drum 5, proximate to the discharge outlets 308, by ensuring that such solid phase falls, by virtue of the vibrations imposed on the half-drum 302, toward the output opening of the discharging station 13, thus preventing building-up of dried solid materials, and so preventing non-operational periods of the centrifugal separator and avoiding manual cleaning interventions. The vibrating unit 300 can be used continuously, or intermittently, as needed. The half-drum 302 also prevents the centrifugal separator 1 from possible damages caused by the impacts of the solids expelled from the discharge outlets 308. The half-drum 302, which also works as a sacrificial plate, is indeed easy accessible by lifting the portion 30 of the casing 3, so that it can be conveniently removed and substituted when damaged.

With regard to the cleaning system 200, it can be actuated cyclically, or when deemed necessary, in order to carry out the cleaning of the separation nets 100, optionally interrupting the flow of feeding of the mixture and optionally reducing the rotation speed of the drum 5.

The separation nets 100, which, thanks to the fixing elements 102 are accessible from the outside once the upper part of the casing 3 is open by means of the handles 32, can be easily replaced, when damaged, or can even be replaced with nets with finer or coarser meshes according to the type of mixture to be treated, or with blind plates. The free choice of providing separation nets with various meshes dimensions allows to effectively process different types of drilling fluids, or in general, various types of mixtures of substances in the liquid phase and in the solid phase.

Furthermore, the adjusting members 104 of the separation nets 100, which are also accessible from the outside, make it possible to finely vary the distance of the nets 100 from the annular screw feeder 90, and optionally also their inclination, so as to ensure that, even in the event of wear or unforeseeable mechanical play, the annular screw feeder 90, in rotation, brushes against the separation nets 100 while keeping at the desired distance from them.

In practice it has been found that the centrifugal separator, according to the present disclosure, achieves the intended aim and objects in that it makes it possible to effectively filter the liquid phase from the solid.

Another advantage of the centrifugal separator consists in that it offers particularly high performance when compared to the known art.

Another advantage of the centrifugal separator consists in that its maintenance and its cleaning are greatly simplified, rapid and effective.

Another advantage consists in that it can be used flexibly for the treatment of various types of drilling fluids, both oil-based and water-based, suspensions, slurries, due to the fact that the separation nets can be changed, and the rotation speeds of the rotatable drum and of the screw feeder can be varied.

Another advantage consists in that it can be used both in the disposal process of the discarded material obtained from the drilling process, and in the drilling process itself In particular, the combined effect of separation by centrifugal stratification and separation by filtering through nets renders the centrifugal separator, particularly effective in the field of "solids control" techniques as well, by combining, in a single machine, both the action of shale shakers and the action of centrifugal separators with frustum-shaped rotatable drum.

In this regard, furthermore, the provision of additional discharge outlets in the bases of the rotatable drum makes it possible to treat heavy flows of drilling fluids, the liquid component of which is greatly predominant with respect to the solid component, or vice versa.

Another advantage concerns the fact that the cylindrical shape of the rotatable drum, instead of frustum-shaped as in conventional centrifugal separators, makes it possible to maintain a constant centrifugal force, as a function of the rotation speed of the drum, along the entire longitudinal extension of the annular chamber where the mixture to be treated passes. By varying the rotation speed of the drum it is possible to vary the centrifugal force and therefore to vary the retention time of the mixture in the rotatable drum. In other words, the retention time, which corresponds to the time during which the mixture is exposed to the separation nets, can be controlled as needed, depending on the type of mixture to be processed.

A further advantage of the centrifugal separator consists in that, due to the high performances achievable and the flexibility in use, it can be used for cleaning and disposing of slop oils. Indeed, slop oils generally contain oil, water and solids in greatly varying proportions, since they derive from a wide variety of sources in refineries or oil fields. The centrifugal separator can also be used in the mining and tunnelling industry, for processing the mined material and managing the large amounts of waste resulting from the mining and tunnelling operations.

The centrifugal separator, thus conceived, is susceptible of numerous modifications and variations, all of which are within the scope of the appended claims.

Moreover, all the details may be substituted by other, technically equivalent elements.

In practice the materials employed, provided they are compatible with the specific use, and the contingent dimensions and shapes, may be any according to requirements.

The invention claimed is:

1. A centrifugal separator comprising a rotatable drum having a wall, an annular chamber defined along a longitudinal axis of the rotatable drum wherein the annular chamber borders the wall and a mixture of substances in a liquid phase and in a solid phase is movable longitudinally through the annular chamber, and a discharging station for discharging the solid phase and comprising a vibrating unit for agitating the solid phase, wherein the vibrating unit comprises a half-drum having a semicircular configuration and a vibrating device adapted to vibrate the half-drum, the half-drum is coupled to a portion of a casing of the centrifugal separator by drum shock absorbers, and the drum shock absorbers are spaced apart from each other along the semicircular configuration of the half-drum.

2. The centrifugal separator according to claim 1, wherein the wall of the rotatable drum comprises, at the discharging station, a plurality of outlets for discharging the solid phase, a portion of the plurality of outlets facing the half-drum.

3. The centrifugal separator according to claim 2, wherein the plurality of outlets is distributed substantially around the entire circumference of the wall of the rotatable drum.

4. The centrifugal separator according claim 1, wherein the half-drum is arranged concentrically with respect to the rotatable drum.

5. The centrifugal separator according claim 1, further comprising:

two extension elements connected to ends of the half-drum so as to define containment walls for the solid phase.

6. The centrifugal separator according to claim 5, wherein the two extension elements are connected to the ends of the half drum by means of shims configured to at least partially transmit the vibration from the half-drum to the extension elements.

7. The centrifugal separator according to claim 5, wherein the extension elements are coupled to the casing of the centrifugal separator by extension shock absorbers.

8. The centrifugal separator according to claim 1, wherein the portion of the casing is capable of being opened for accessing said half-drum.

* * * * *